US006050504A

United States Patent [19]

Schultz et al.

[11] Patent Number: 6,050,504

[45] Date of Patent: Apr. 18, 2000

[54] SPRAY DISPENSING DEVICE USING SWIRL PASSAGES AND USING THE BERNOULLI EFFECT

[75] Inventors: Robert S. Schultz, Old Greenwich; Philip M. Miller, North Haven, both of Conn.

[73] Assignee: Emson, Inc., Bridgeport, Conn.

[21] Appl. No.: 09/073,615

[22] Filed: May 6, 1998

[51] Int. Cl.[7] ..... B65D 1/32

[52] U.S. Cl. ..... 239/327; 239/403; 239/434

[58] Field of Search ..... 239/123, 327, 239/328, 401, 403, 405, 434, 452, 470, 533.1, 570, 602; 222/206, 211, 212, 215, 484, 488, 554, 631–3

[56] References Cited

U.S. PATENT DOCUMENTS

| | | | |
|---|---|---|---|
| 3,170,633 | 2/1965 | Castelli | 222/633 |
| 3,217,986 | 11/1965 | Davis, Sr. et al. | 239/405 |
| 3,363,808 | 1/1968 | Gorman | 222/193 |
| 4,162,749 | 7/1979 | Bennett | 222/633 |
| 4,186,882 | 2/1980 | Szcepanski | 239/327 |
| 4,223,842 | 9/1980 | Hayes | 239/327 |
| 4,396,152 | 8/1983 | Abplanlp | 239/337 |
| 4,415,122 | 11/1983 | Laauwe | 239/327 |
| 5,042,697 | 8/1991 | Warren | 239/405 |
| 5,183,186 | 2/1993 | Delaney, Jr. | 222/211 |
| 5,197,638 | 3/1993 | Wood | 222/212 |
| 5,273,191 | 12/1993 | Meshberg | 222/105 |
| 5,301,846 | 4/1994 | Schmitz | 222/211 |
| 5,318,205 | 6/1994 | Delaney, Jr. | 222/211 |

*Primary Examiner*—Andres Kashnikow
*Assistant Examiner*—Lisa Ann Douglas
*Attorney, Agent, or Firm*—Kenyon & Kenyon

[57] ABSTRACT

A spray dispensing device is provided which can be used with non-pressurized containers. The device includes passageways for directing streams of air and, liquid where the liquid is broken up into droplets and emitted as a fine spray through an orifice. An annular air passageway is concentrically disposed around a liquid passageway, and the air is lead through air swirl passages, where the annular stream of air is given a rotary motion as the result of swirl vanes forming the air swirl passages. The velocity of air past a product passageway exit orifice also creates a Bernoulli effect which reduces pressure at that orifice, which acts to draw liquid to the spray orifice. The device may include a dip tube for the liquid which is provided with a check valve for retaining liquid at a high level in the dip tube after each spray cycle so that spraying is nearly instantaneous upon actuation. Several embodiments of reciprocating closure valves may be used to close the orifice to prevent drying withing the product passageway.

26 Claims, 3 Drawing Sheets

SPRAY DISPENSING DEVICE USING SWIRL PASSAGES AND USING THE BERNOULLI EFFECT

BACKGROUND OF THE INVENTION

1. Field of the Invention

The invention relates generally to devices for atomizing fluent materials. More particularly, this invention relates to highly efficient dispensing arrangement for use with squeeze-type containers.

2. Description of the Prior Art

Although squeeze bottle types sprayers have been used for many years, such sprayers were largely replaced for a long period of time by pressurized can dispensing systems. One squeeze bottle dispenser which has come into use as a substitute for pressurized cans is described in U.S. Pat. Nos. 5,183,186 and 5,318,205. These patents show a squeeze bottle dispenser in which an air passageway and a product (i.e., fluent material) passageway meet in a tapered mixing chamber. In the device of that invention, the tapering of the mixing chamber direct the air flow at an angle to the flow of liquid, resulting in turbulence in the liquid in the mixing chamber. This turbulence breaks the liquid up and intimately mixes it with the air. As a result, a fine spray is propelled out of the orifice.

Another patent relating to squeeze bottles is U.S. Pat. No. 5,273,191. That patent also describes a squeeze bottle using a tapered mixing chamber for mixing air and liquid. In that patent, various valving arrangements are shown, including valved gaskets for controlling the flow of liquid to the mixing chamber and for controlling the flow of air to the mixing chamber and into the squeeze bottle. In addition, that patent shows a biased valve element which opens and closes the liquid passage in response to the pressure in the liquid passage.

SUMMARY OF THE INVENTION

It is an object of the invention to provide a spray dispensing device for use with a non-pressurized container, such as a squeeze bottle, which very effectively atomizes fluent material stored in the container.

It is a further object of the invention to provide a spray dispensing device which produces a spray which exhibits a circular and symmetrical spray pattern wherein the droplet size distribution is symmetrical and conforms to a bell curve, where a smaller particle size is created, and which creates a wide spray pattern.

It is an additional object of the invention to provide an improved valving mechanism for the liquid spray passage of a squeeze bottle dispenser.

It is another object of the invention to provide improved closure mechanism for closing off the dispensing orifice of a squeeze bottle dispenser, to thereby reduce drying and clogging.

In accordance with the invention a spray dispenser is provided having a dip tube which can extend into a container, such as a squeeze bottle, holding a quantity of liquid. The top of the dip tube is connected to a ballcheck valve assembly having a ball which ordinarily rests on top of a conduit of restricted diameter. Slots above the ballcheck valve restrain upward movement of the ballcheck valve during spraying, and also allow better flow of liquid. An air passage in the spray dispenser can connect the inside of the bottle with air swirl passages in the dispenser. A separate product passage leads from the top of the ballcheck valve to a point adjacent to the air swirl passages and is directed toward a spray orifice. The air passage is an annular passageway which is concentrically disposed around a portion of the product passage leading to the air swirl passages.

When the bottle is squeezed, the resulting pressure build up forces air into the air swirl passages and liquid up the dip tube. The liquid forces the ballcheck to open and the liquid is directed toward the air swirl passages. Simultaneously, air is forced through the annular air passage. The annular 360 degree stream of air converges and impinges upon the core stream of liquid, after deflection by swirl vanes defining the air swirl passages, at a point in proximity to the spray orifice. This causes a particularly effective atomization of the liquid and a fine spray is expelled through the orifice. Furthermore, the velocity of the air flowing across the exit from the liquid product passage causes a reduction in pressure at that exit, which pressure reduction—as a result of the Bernoulli effect—draws the liquid from the dispensing container and in proximity to the air swirl passages. The resulting spray pattern is symmetrical and circular and the droplets exhibit a symmetrical droplet size distribution which ordinarily conforms to a bell curve. The spray pattern is wider than prior art devices, and the droplets are of a finer particle size.

As the pressure in the bottle is relieved, the ball drops down back onto the conduit of restricted diameter thereby trapping product in the dip tube. Thus, product will be retained in the dip tube at a high level, above the liquid level in the bottle, ready for the next squeeze cycle. In this way the lag time which ordinarily occurs prior to spraying is eliminated.

The product passage is formed in a valve which is housed in a body of the spray dispenser. The valve may advantageously be formed as a push-pull valve which opens and closes the dispensing orifice. In a closed position of the valve, the product dispensing orifice is completely closed, thereby preventing air from entering into the inside of the squeeze bottle or the liquid passage. This closing off of the dispensing orifice therefore reduces potential drying of the liquid product in the liquid passage or the squeeze bottle, which could result in clogging.

In the present invention, the size of the air exit orifice can be molded in different sizes to thereby control the wetness or dryness of the resulting spray by varying the ratio of liquid to air in the spray.

BRIEF DESCRIPTION OF THE DRAWINGS

Other objects and advantages of the invention will be apparent from the specification and claims, when considered in connection with the attached sheets of drawings, illustrating one form of the invention, wherein like characters represent like parts and in which:

DETAILED DESCRIPTION OF THE DRAWINGS

Figure 2:
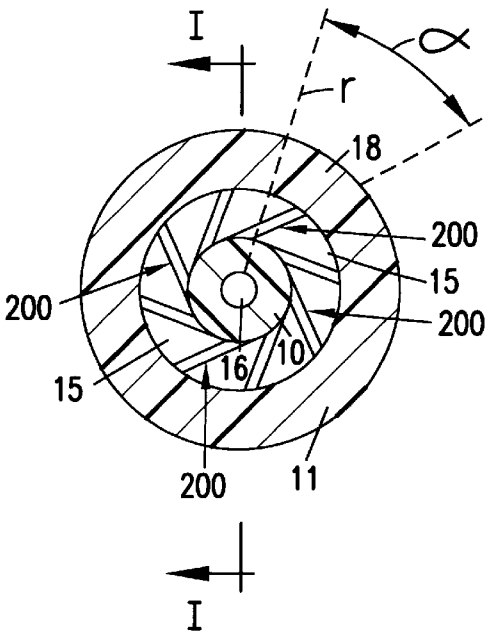
FIG. 2 is a cross sectional view, through line II—II in FIG. 1, of air swirl passages of the embodiment of FIG. 1.
Figure 1:
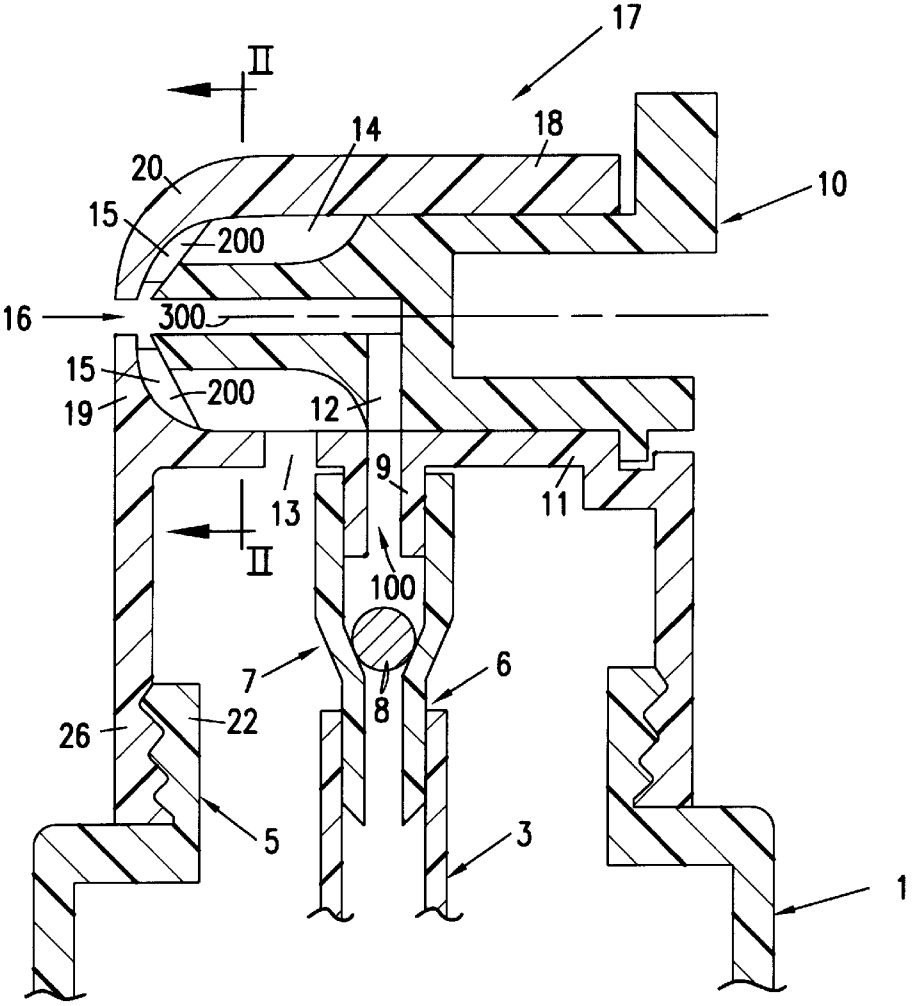
FIG. 1 is a cross sectional view through a first embodiment of a dispensing head of a squeeze bottle of the present invention.

As shown in FIG. 1, the spray dispensing system of the present invention includes a squeezable bottle 1 holding a quantity of a liquid or other fluent material. Squeezable bottle 1 can be made from any suitable resilient plastic material known in the art.

A spray dispensing device housing or sprayer body 17 is adapted to be mountable atop a neck 5 of bottle 1. The spray dispensing device housing 17 includes a dip tube 3 which is sized so that its bottom open end is disposed near the bottom of bottle 1 when the spray dispensing device is mounted on the bottle 1. The top end of dip tube 3 receives a restricted conduit 6 of a ballcheck valve 7. Restricted conduit 6 communicates with dip tube 3 so as to allow fluid to pass through. The inner diameter of restricted conduit 6 is smaller than the diameter of ball 8 of ballcheck valve 7 so that ball 8 ordinarily sits atop restricted conduit 6. When ball 8 is in this position, the ballcheck valve 7 is closed so that the top end of dip tube 3 is also closed. The inner diameter of the remainder of ballcheck valve 7 is larger than the diameter of ball 8. In this way ball 8 is free to move upward in response to upward movement of fluid in the dip tube to open ballcheck valve 7.

The top of ballcheck valve 7 receives a coaxially disposed feed tube 9 which allows for the passage of fluid from restricted conduit 6 toward valve 10. Feed tube 9 has an inner diameter which is smaller than the diameter of ball 8 so as to limit the movement of ball 8 in an upward direction. The end of feed tube 9 includes a series of circumferentially spaced radial slots 100. Slots 100 allow the free flow of fluid through ballcheck valve 7 to the feed tube 9 when the ball 8 moves upwardly in response to the upward movement of fluid. Therefore, feed tube 9 is positioned a small distance upward from ball 8 so that ball 8 is free to move upward to open ballcheck valve 7.

For simplicity of construction feed tube 9 is an extension of a valve wall 11 of housing 17. Feed tube 9 of valve wall 11 can communicate with a product passageway 12 within valve 10 when valve 10 is in an open position. Valve wall 11 is also provided with an air orifice 13 which communicates with an annular air passageway 14. As illustrated in FIG. 1, the annular air passageway 14 is defined as the space between the body of valve 10 and the valve walls 11 and 18, so that it is concentrically disposed around the portion of the product passageway 12 which leads to the air swirl passages 15 in an axial horizontal direction. Valve 10 may be rotatably received in the cavity between valve walls 11 and 18 of spray dispenser housing 17.

End portions 19 and 20 of valve walls 11 and 18, respectively, define walls of passages which shall be referred to as the air swirl passages 15. A portion of the product passageway 12 leads to the air swirl passages 15 in a generally axial direction. Product passageway 12 preferably terminates in a product passageway exit orifice 300 located at one end of the air swirl passages 15. As illustrated in FIG. 1, the annular air passageway 14 is concentrically disposed around the portion of the product passageway 12 which leads to the air swirl passages 15 in an axial direction. End portions 19 and 20 define a spray orifice 16 at the ends of the air swirl passages 15 and opposite the product passageway exit orifice 300.

The air swirl passages 15 are defined by a series of swirl vanes 200. Swirl vanes 200 preferably are disposed at an angle $\alpha$ to a radius r of the spray dispenser housing 17. At least three swirl vanes 200 should be used. Swirl vanes are preferably molded to extend axially from end portions 19 and 20.

Housing 17 is connected to the top of bottle neck 5 by any known securing mechanism, such as, for example, helical screw threads 26, 22. A gasket (not shown) may be located between housing 17 and bottle neck 5, to seal the housing 17 to the bottle neck.

The spray dispensing device can be conveniently removed from bottle 1 as a unit by simply unscrewing threads 26, 22 to separate housing 17 from bottle neck 5. This feature has the advantage of allowing the bottle 1 to be refilled with product. The spray dispensing system is then easily reconnected to bottle neck 5 by ring 21.

In the embodiment of FIG. 1, valve 10 is housed within the cavity between valve walls 11 and 18 of housing 17. Valve 10 in the embodiment of FIG. 1 is rotatable about its longitudinal axis between a completely closed position (not shown) and a completely open position (FIG. 1). In the completely closed position the product passageway 12 is not aligned with the feed tube 9. In this position the body of valve 10 completely seals off feed tube 9. Yet, in the closed position, the air passageway 14 can remain in communication with the air orifice 13.

The structure of valve 10 of the embodiment of FIG. 1 is such that as the valve is rotated toward the completely open position, the air passageway 14 is already aligned with air orifice 13 before product passageway 12 begins to communicate with feed tube 9. Upon continued rotation of the valve toward the completely open position, the product passageway begins to communicate with feed tube 9, allowing a certain extent of communication between the feed tube 9 and the spray orifice 16 so that a thin stream of liquid can pass to the spray orifice 16 at a certain flow rate. The flow rate is the volume of liquid which can flow per unit of time through the feed tube 9, through the product passageway 12 and into the spray orifice. Upon continued rotation of the valve 10 toward the completely open position, the extent of the communication between feed tube 9 and product passageway 12 increases, thereby increasing the extent of communication between the feed tube and the product passageway to allow a larger volume of liquid to pass to the spray orifice 16 (i.e., an increased flow rate). However, the extent of communication between air orifice 13 and the air swirl passages 15 is already at its constant maximum before product passageway 12 even begins to communicate with feed tube 9. Therefore, the ratio of liquid to air which is delivered to the spray orifice 16 will increase as the valve 10 is rotated toward the completely open position thereby increasing the wetness of the spray. This feature therefore allows for fine tuning or minor adjustments to the wetness of the spray. In the completely open position of valve 10, the extent of communication between product passageway 12 and feed tube 9 is at a maximum so that the ratio of liquid to air delivered to the spray orifice 16 is at a maximum. Thus, it can be seen that the wetness of the spray can be fine tuned by adjusting valve 10.

Another technique which is useful in regulating the wetness or dryness of the spray is to control the size of the air orifice 13. This feature allows major adjustment of the wetness or dryness of the spray exiting through the spray orifice 16. In the embodiment of the present invention, this would be accomplished during the process of molding the housing 17, by using different sized molding pins in the mold cavity to mold the air orifice 13. As will be readily understood, the smaller the air orifice 13, the smaller the volume per unit time of air that will pass into the air swirl passages 15. As a result, a smaller air orifice 13 will result in a greater ratio of liquid to air in the spray orifice 16, resulting in a wetter spray. A dryer spray will, of course, be achieved using a larger air orifice 13.

The squeeze bottle dispenser of the present invention may rely upon the Bernoulli effect to assist in the dispensing of spray and the regulation of the characteristics of the spray. As is known, the flow of a fluid approximately perpendicular to an orifice creates a reduction in pressure at that orifice. In the present invention, the flow of air in the air swirl passages 15 in a direction approximately perpendicular to the product passageway exit orifice 300 results in a reduction in pressure at the product passageway exit orifice 300. This reduction in pressure draws liquid toward the product passageway exit orifice 300 from the product passageway 12. As a result, liquid product is more readily drawn into the spray orifice 16 for dispensing as spray.

Figure 3:
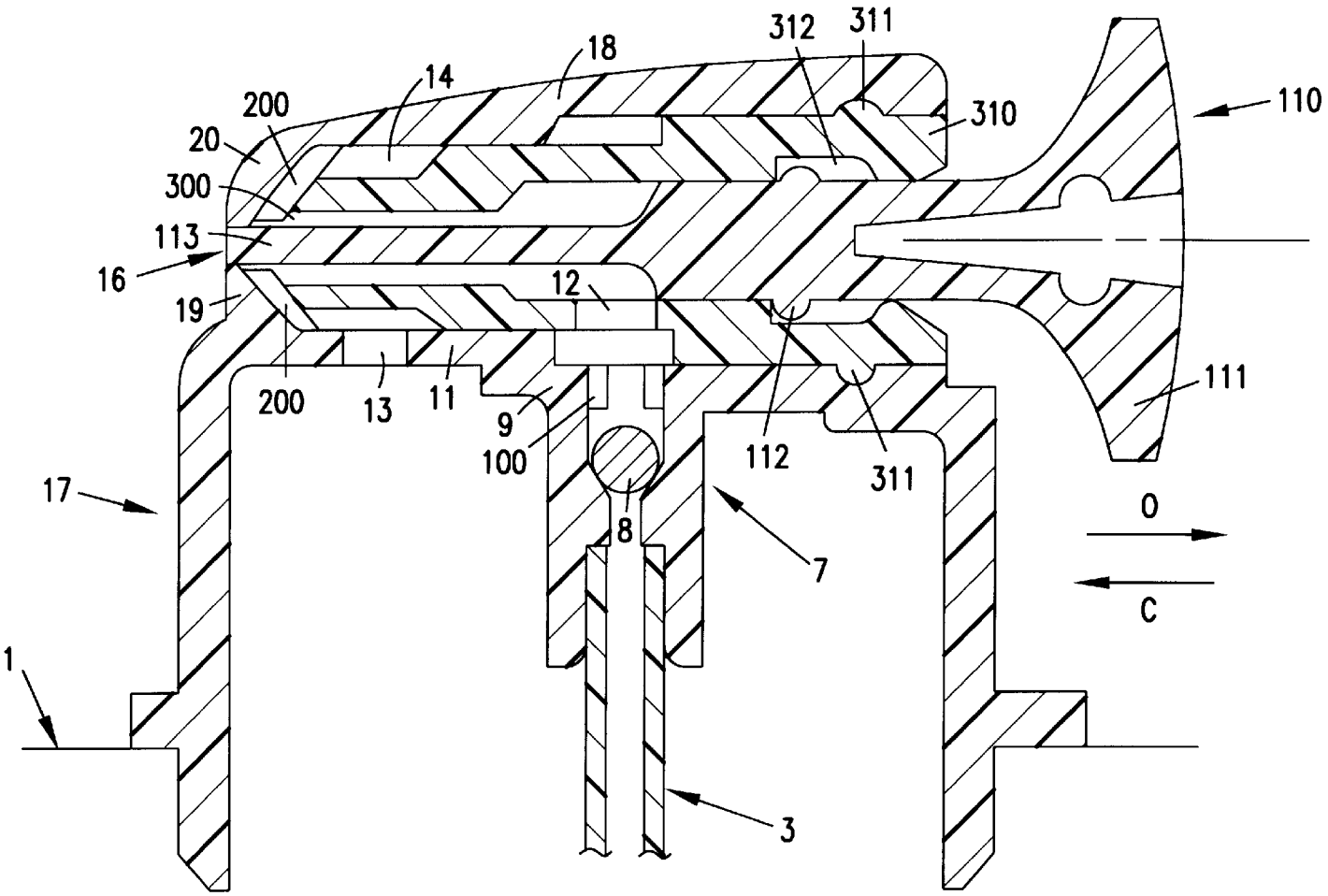
FIG. 3 is a cross sectional view through a second embodiment of a dispensing head of a squeeze bottle of the present invention.
Figure 4:
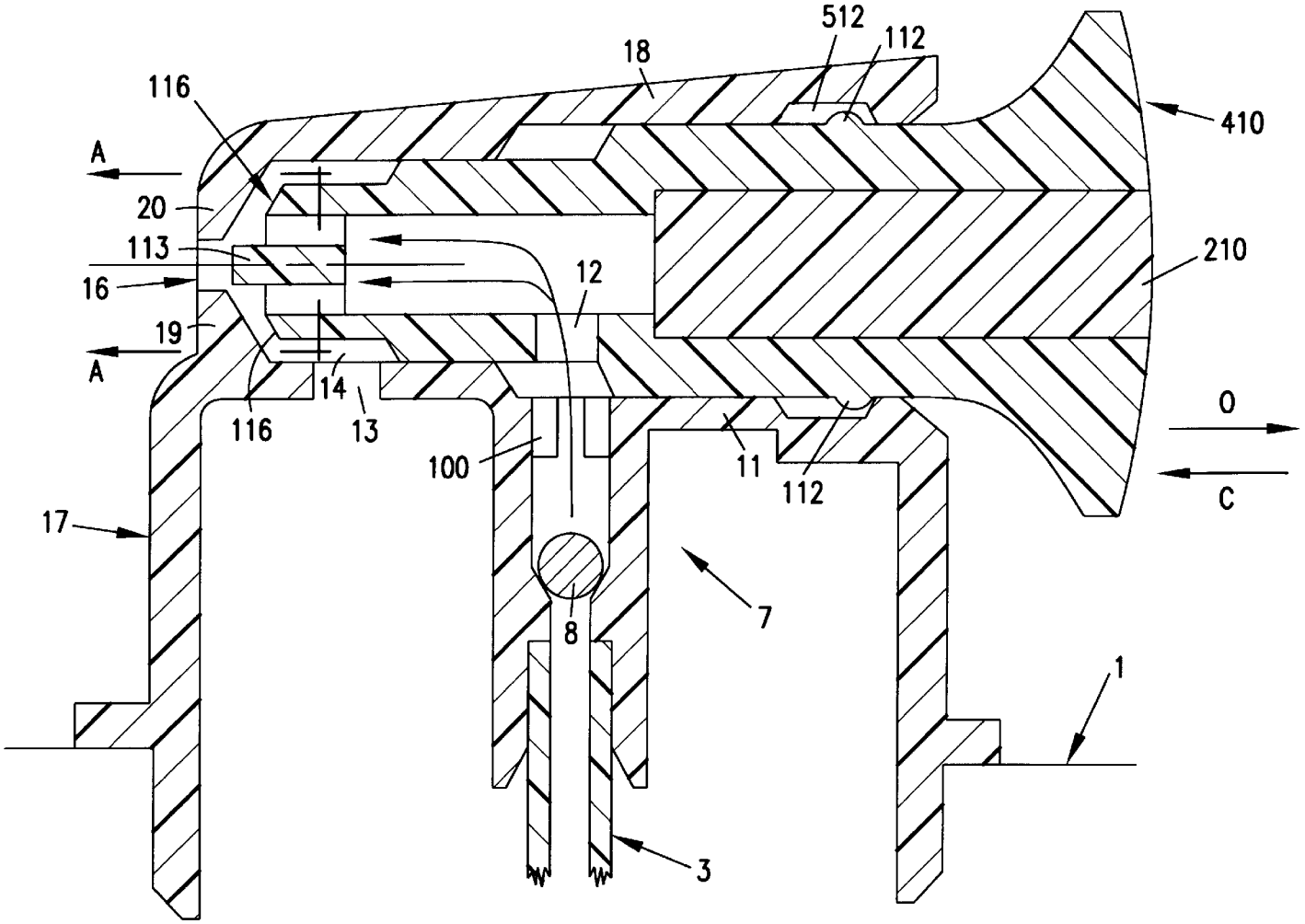
FIG. 4 is a cross sectional view through a third embodiment of a dispensing head of a squeeze bottle of the present invention.
Figure 4A:
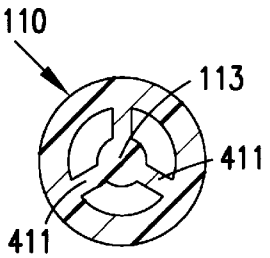
FIG. 4*a* is a cross sectional view through line A—A in FIG. 4.

It should be appreciated by those skilled in the art that variations in the design of valve 10 are possible. For example, instead of being rotatable, the valve may be slidable. FIGS. 3 and 4 show two embodiments which use slidable valves.

In the embodiment of FIG. 3, a slide housing 310 is secured, preferably using a snap connection 311, between the valve walls 11 and 18 of housing 17. Product passageway 12 passes through a portion of slide housing 310. Slidably received within slide housing 310 is a slide valve 110. Slide valve 110 includes a pull knob 111 which is grasped by the user to push and pull the slide valve 110 in the opening direction O and the closing direction C. A rim 112 on slide valve 110 slides in a restraining chamber 312 in slide housing 310, to restrain the inward and outward movement of the slide valve 110. Slide valve 110 includes a stem 113 which projects into the product passageway, and in the closed position (shown in FIG. 3), the stem 113 enters into, and closes off, the spray orifice 16. From this position, if the pull knob 111 is moved in the opening direction O, the tip of the stem 113 moves out of the spray orifice 16, so that it rests at the product passageway exit orifice 300. In contrast to the embodiment shown in FIG. 1, the embodiment of FIG. 3 is designed so that there is no regulation of the extent of communication between the product passageway 12 and the feed tube 9, and the degree of communication between the product passageway 12 and the feed tube 9 is always the same. Therefore, movement of the position of the slide valve 110 does not effect the dryness or wetness of the spray. The dryness or wetness of the spray can, however, be controlled by controlling the size of the air orifice 13 during molding. In other respects, the embodiment of FIG. 3 operates in a manner identical to the embodiment of FIG. 1, in that it includes swirl vanes 200 forming air swirl passages 15, and the air passes approximately perpendicular to product passageway exit orifice 300, so that the Bernoulli effect assists in drawing liquid product from the product passageway 12 into the spray orifice 16.

FIG. 4 shows an alternative embodiment of a slide valve 410 of the present invention. In the embodiment of FIG. 1, slide valve 410 includes a pull knob 111 which is grasped by the user to push and pull the slide valve 110 in the opening direction O and the closing direction C. A rim 112 on slide valve 410 slides in a restraining chamber 512 located in valve walls 11 and 18 of housing 17, to restrain the inward and outward movement of the slide valve 410. The product passage 12 is molded in slide valve 410. Slide valve 410 has mounted within in it an insert 210. A stem 113 projects into the product passageway 12. The stem 113 is integrally molded with the slide valve 410, via radial ribs 411, which ribs 411 create passages for fluid to flow between the slide valve 410 and the radial ribs 411. In the closed position, the stem 113 enters into, and closes off, the spray orifice 16. From this position, if the pull knob 111 is moved in the opening direction O, the tip of the stem 113 moves out of the spray orifice 16, as shown in FIG. 4. In the closed position, an end surface 116 of slide valve 410 rests against end portion 20, and therefore seals off the air orifice 13 and air passageway 14. Like the embodiment of FIG. 3, the embodiment of FIG. 4 is designed so that there is no regulation of the extent of communication between the product passageway 12 and the feed tube 9. Movement of the position of the slide valve 410 does not effect the dryness or wetness of the spray. The dryness or wetness of the spray can, however, be controlled by controlling the size of the air orifice 13 during molding.

The operation of the spray dispensing device of the invention as used with a squeeze bottle will now be explained by describing the path of fluid and air. Upon squeezing the bottle 1 the pressure inside the bottle increases urging fluid up dip tube 3. At the same time, air is forced through air orifice 13, air passageway 14 and into air swirl passages 15, passing approximately perpendicularly to the product passageway exit orifice 300, thereby creating a reduced pressure at product passageway exit orifice 300. Fluid is forced, by the increased pressure in squeeze bottle 1, and drawn, by the reduced pressure at product passageway exit orifice 300, up dip tube 3, pushing ball 8 upward, thereby opening ballcheck valve 7. The fluid is then free to flow into feed tube 9 toward product passageway 12. From passageway 12 the fluid stream is injected in an axial direction toward the spray orifice 16. The product passageway 12 meets the air swirl passages 15 in the vicinity of the spray orifice 16.

As described above, upon squeezing the bottle the increase in pressure also forces air located above the fluid level in the bottle through air orifice 13 into the annular air passageway 14. It can be seen that the distance which must be traveled by the air to reach the air swirl passages 15 is less than the distance which must be traveled by the liquid to reach the product passageway exit orifice 300, so that liquid does not reach the spray orifice 16 before the air. In this way, it is made certain that the fluid is mixed with air before emanating from orifice 16, and also that a Bernoulli effect is always produced at product passageway exit orifice 300 to assist in drawing fluid to the orifice 16.

The annular air passageway 14 leads to the air swirl passages 15, and the swirl vanes 200 create a rotary motion in the air in the air swirl passages 15. The liquid is subjected to considerable turbulence which breaks it up and intimately mixes it with the air, and the rotary motion of the air also helps to widen the resulting spray pattern. The result is that a fine spray is propelled out of orifice 16 which exhibits a wide and symmetrical spray pattern wherein the droplets exhibit a finer particle size, a more uniform particle size distribution and a wider particle distribution. Because of the use of air swirl passages 15 with swirl vanes 200, the passage through which the air passes before contacting the liquid passes is reduced in size compared to prior art squeeze bottle designs (e.g., U.S. Pat. Nos. 5,183,186 and 5,318,205) using a tapered mixing chamber, thereby increasing the speed of the air passing across the product passageway exit orifice 300 and producing a Bernoulli effect to draw liquid through the product passageway 12.

When pressure is released on the bottle 1, it returns to its original shape (because it is made of a resilient material, and external air is drawn into the container through orifice 16, air passageway 14 and air orifice 13. The drawing of air through orifice 16 cleans the orifice and the air swirl passages 15 after each squeeze cycle thereby inhibiting clogging of the orifice. This self-cleaning feature of the invention is particularly advantageous in the case of a viscous product where clogging is most frequently encountered. In the embodiments of FIGS. 3 and 4, the closing of the orifice 16 by stem 113 also prevents the encroachment of air into the product passageway 12, which also reduces the chances that product will dry in the product passageway 12 and therefore clog product passageway 12.

The release of pressure also causes liquid to drop down feed tube 9 which helps ball 8 to drop, thereby closing the ballcheck valve 7. It will be appreciated that the closing of the ballcheck valve 7 by ball 8 will trap liquid in dip tube 3. Thus, during the next squeeze cycle product will already be at a very high level in the dip tube 3 so that less time will be required before spray is emitted. In this way the present invention achieves nearly instantaneous spraying without the need for a pressurized container.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are accordingly to be regarded in an illustrative rather than a restrictive sense.

What is claimed is:

1. A squeeze bottle sprayer which emits a liquid-air spray, comprising:

a squeezable bottle containing a volume of liquid and air above the liquid;

a dip tube extending into the volume of liquid;

a sprayer body including a spray orifice;

a liquid passageway in communication with the dip tube and the spray orifice;

an air passageway, the air passageway communicating with an interior of the bottle containing the volume of air, the air passageway also communicating with the spray orifice; and a plurality of ribs forming the air passageway between the ribs and reducing the air passageway to the least area at the liquid orifice, thereby increasing the speed of air and lowering the effective pressure at the liquid orifice.

2. The squeeze bottle sprayer of claim 1, wherein:

the plurality of ribs are at an angle to a radius of the sprayer body, thereby imparting a swirling motion to the air.

3. The squeeze bottle sprayer of claim 1, wherein:

the liquid passageway terminates in a liquid passageway orifice, and wherein a flow of air past the liquid passageway orifice is approximately 45 degrees to the orifice, thereby creating a reduced pressure at the orifice.

4. The squeeze bottle sprayer of claim 1, further comprising:

a valve, the valve defining a portion of the liquid passageway, the valve closing the spray orifice in a closed position of the valve.

5. The squeeze bottle sprayer of claim 4, wherein:

the valve is a slidable valve.

6. The squeeze bottle sprayer of claim 5, wherein:

the valve includes a stem which projects into the spray orifice in the closed position of the valve.

7. The squeeze bottle sprayer of claim 5, wherein:

the valve includes a slide housing in which the valve slides.

8. The squeeze bottle sprayer of claim 1, further comprising:

a check valve between the dip tube and the liquid passage.

9. The squeeze bottle sprayer of claim 8, wherein:

the check valve is a ballcheck valve including a ball.

10. The squeeze bottle sprayer of claim 9, wherein:

the ballcheck valve includes slots above the ball.

11. The squeeze bottle sprayer of claim 1, wherein:

the air passageway includes an air orifice, a size of the air orifice controlling the wetness of spray from the spray orifice.

12. The squeeze bottle sprayer of claim 4, wherein:

the valve is a rotatable valve.

13. The squeeze bottle sprayer of claim 12, wherein: the valve includes a housing in which the valve rotates.

14. A squeeze bottle sprayer which emits a liquid-air spray, comprising:

a squeezable bottle containing a volume of liquid and air above the liquid;

a dip tube extending into the volume of liquid;

a sprayer body including a spray orifice;

a liquid passageway in communication with the dip tube and the spray orifice, the liquid passageway terminating in a liquid passageway orifice;

an air passageway, the air passageway communicating with an interior of the bottle containing the volume of air, the air passageway also communicating with the spray orifice, the flow of air from the air passageway toward the liquid passageway being approximately 45 degrees to the liquid passageway orifice.

15. The squeeze bottle sprayer of claim 14, further comprising:

a valve, the valve defining a portion of the liquid passageway, the valve closing the spray orifice in a closed position of the valve.

16. The squeeze bottle sprayer of claim 15, wherein:

the valve is a slidable valve.

17. The squeeze bottle sprayer of claim 16, wherein:

the valve includes a stem which projects into the spray orifice in the closed position of the valve.

18. The squeeze bottle sprayer of claim 16, wherein:

the valve includes a slide housing in which the valve slides.

19. The squeeze bottle sprayer of claim 14, further comprising:

a check valve between the dip tube and the liquid passage.

20. The squeeze bottle sprayer of claim 19, wherein:

the check valve is a ballcheck valve including a ball.

21. The squeeze bottle sprayer of claim 20, wherein:

the ballcheck valve includes slots above the ball.

22. The squeeze bottle sprayer of claim 14, wherein:

the air passageway includes an air orifice, a size of the air orifice controlling the wetness of spray from the spray orifice.

23. The squeeze bottle sprayer of claim 14, further comprising:

a plurality of ribs in the air passageway.

24. The squeeze bottle sprayer of claim 23, wherein:

the plurality of ribs are at an angle to a radius of the sprayer body.

25. The squeeze bottle sprayer of claim 15, wherein:

the valve is a rotatable valve.

26. The squeeze bottle sprayer of claim 25, wherein:

the valve includes a housing in which the valve rotates.

* * * * *